US005101703A

United States Patent [19]

Tanaka et al.

[11] Patent Number: 5,101,703

[45] Date of Patent: Apr. 7, 1992

[54] BOX CUTTING METHOD AND APPARATUS THEREOF

[75] Inventors: Nobuhiro Tanaka, Miyashiro; Eiji Hirata, Koshigaya; Manabu Kobuki, Koga; Yasuro Katayama, Fukuma, all of Japan

[73] Assignees: KAO Corporation, Tokyo; Seibu Electric & Machinery Co., Ltd., Fukuoka, both of Japan

[21] Appl. No.: 402,884

[22] Filed: Sep. 5, 1989

[30] Foreign Application Priority Data

Sep. 8, 1988 [JP] Japan ..... 63-226149

[51] Int. Cl.[5] ..... B26D 3/08

[52] U.S. Cl. ..... 83/880; 83/17; 83/176; 83/282; 83/368; 83/946; 53/492; 414/412; 30/2

[58] Field of Search ..... 83/51, 54, 206, 212.1, 83/256, 282, 946, 880, 881, 885, 874, 865, 861, 407, 368, 370, 17, 176; 53/492, 381 R; 414/412; 30/2

[56] References Cited

U.S. PATENT DOCUMENTS

| | | | |
|---|---|---|---|
| 2,729,885 | 1/1956 | Wahl et al. | 414/412 X |
| 2,997,833 | 8/1961 | Nigrelli et al. | 53/381 R X |
| 3,135,049 | 6/1964 | Daugherty et al. | 83/946 X |
| 3,137,068 | 6/1964 | Quigley | 83/946 X |
| 3,266,541 | 8/1966 | Kluytenaar et al. | 414/412 X |
| 3,457,642 | 7/1969 | Steer et al. | 83/946 X |
| 3,763,557 | 10/1973 | Sewell | 83/368 X |
| 3,888,150 | 6/1975 | Stroud et al. | 83/368 |
| 3,889,442 | 6/1975 | Grahn et al. | 53/492 |
| 4,112,986 | 9/1978 | Strange et al. | 83/368 X |
| 4,553,464 | 11/1985 | Turner et al. | 83/865 |

FOREIGN PATENT DOCUMENTS

| | | |
|---|---|---|
| 52278178 | 5/1972 | Japan . |
| 6311297 | 6/1986 | Japan . |

*Primary Examiner*—Frank T. Yost
*Assistant Examiner*—Rinaldi Rada

[57] ABSTRACT

A box cutting method is characterized in that after moving a cutter for cutting a box to a predetermined position which is determined in accordance with the size of the box, the box is cut by moving the cutter along a cutting line formed on the box.

5 Claims, 11 Drawing Sheets

BOX CUTTING METHOD AND APPARATUS THEREOF

BACKGROUND OF THE INVENTION

1. Field of the Invention

This invention relates a box cutting method and an apparatus for carrying out the method, and particularly to a box cutting method and an apparatus for carrying out the method which is suitably used for collectively cutting desired upper edge portions of a plurality of boxes and opening top surfaces of the boxes without damaging or injuring goods contained in the boxes and without generating cutting chips.

2. Description of the Prior Art

As a conventional box cutting method and an apparatus for carrying out the method, there are some as disclosed in Japanese Patent Early Laid-open Publication No. Sho 63-11297, Japanses Utility Model Publication No. Sho 52-27178, etc.

The prior art disclosed in the above-mentioned Publications will be described. Japanese Patent Early Laid-open Publication No. Sho 63-11297 discloses a box cutting apparatus including a conveyor for transferring a box, and a cutter disposed at an upper part of the conveyor and adapted to cut an upper edge or the vicinity of the upper edge of the box in accordance with the movement of the conveyor.

Similarly, Japanese Utility Model Publication No. Sho 52-27178 discloses a package unpacking device comprising a bottom cutter and an upper cutter for cutting both sides of a bottom portion of a package and an upper portion thereof.

However, the prior art has the following problems.

That is, the box cutting apparatus disclosed in Japanese Patent Early Laid-open Publication No. Sho 63-11297 and the package unpacking device disclosed in Japanese Utility Model Publication No. Sho 52-27178 are designed such that an upper edge portion or an upper portion of a transferring box is cut by moving the box with respect to a cutter body which is held in a predetermined position. Accordingly, the box is swayed while it is transferred and the box is deformed by resistance when it is cut, which makes it impossible to cut the box at a desired place correctly. The result is that goods contained in the box are damaged and the box is cut in a wrong manner.

Also, the above-mentioned box cutting apparatus or the above-mentioned package unpacking device is designed such that the boxes are individually cut. Accordingly, cutting efficiency is low. In addition, the Publications do not disclose nor even suggest that a plurality of boxes are collectively cut.

Further, the above-mentioned box cutting apparatus or the above-mentioned package unpacking device does not disclose nor even suggest that boxes, which are being transferred, are cut or not cut according to necessity. In other words, the Publications do not disclose nor even suggest that only an upper edge portion of a desired box is cut.

Furthermore, the above-mentioned box cutting apparatus or the above-mentioned package unpacking device is designed such that an upper edge portion or an upper portion of a box is cut without putting aside goods contained in the box inwardly. Accordingly, goods contained in the box are sometimes damaged.

Still further, the above-mentioned box cutting apparatus is designed such that a pair of opposite cutting knives are inserted with respect to a top surface and a side surface of a box to cut down an upper edge portion of the box at angles. Accordingly, the cutting pieces or cutting chips must be removed.

Still further, the above-mentioned box cutting apparatus or the above-mentioned package unpacking device is designed such that all boxes are cut at an equal cutting depth. Accordingly, the box cannot be correctly cut at a desired deep position. The result is that goods contained in the box are sometimes damaged and the box is sometimes cut in a wrong manner.

Moreover, the above-mentioned box cutting apparatus or the above-mentioned package unpacking device does not disclose nor even suggest that a cutting knife position of a box is determined with reference to a position where a clamping plate pressing the side surface of the box clamps the box.

SUMMARY OF THE INVENTION

It is therefore a first object of the present invention to provide a box cutting method and an apparatus for carrying out the method, which is capable of cutting a box with accuracy and reliability by moving a cutter adapted to cut the box along a cutting line formed on the box.

A second object of the present invention is to provide a box cutting method which is capable of cutting a box with high efficiency by means of collectively cutting a plurality of boxes.

A third object of the present invention is to provide a box cutting method and an apparatus for carrying out the method, which is capable of cutting only a desired upper edge portion of a box by including an independent movement step for independently moving a plurality of cutter bodies adapted to cut a box in the generally vertical direction, i.e., by including a cutter body verical movement portion for moving a cutter body in the generally vertical direction.

A fourth object of the present invention is to provide a box cutting method and an apparatus for carrying out the method, which is capable of cutting a box without damaging goods contained in the box by inwardly putting aside the goods contained in the box.

A fifth object of the present invention is to provide a box cutting method and an apparatus for carrying out the method, which is capable of cutting an upper edge portion of a box without generating cutting chips by inserting a cutting knife at angles with respect to a top surface of the box.

A sixth object of the present invention is to provide a box cutting method, which is capable of cutting a box with accuracy and with reliablility by cutting the box at a cutting depth from a top surface which is preset in accordance with the size of the box.

A seventh object of the present invention is to provide a box cutting method, which is capable of cutting a box with accuracy and reliability by determining a position of a cutting knife with reference to a position where a clamping plate presses the side surface of the box.

The first object fo the present invention can be achieved by providing a box cutting method characterized in that after moving a cutter for cutting a box to a predetermined position which is determined in accordance with the size of said box, said box is cut by moving said cutter along a cutting line formed on said box.

The first object of the invention can also be achieved by providing a box cutting apparatus, which is capable of carrying out the above-mentioned method in a suitable manner, including a cutter for cutting a box, a vertical movement device for moving said cutter in the generally vertical direction, a horizontal movement device for moving said cutter in the generally horizontal direction, and a back and forth movement device for moving said cutter along a cutting line formed on said box.

That is, according to a box cutting method of the present invention which uses a box cutting apparatus of the present invention, a box can be cut with accuracy and with reliability by moving a cutter adapted to cut a box along a cutting line formed on the box.

Likewise, the second object of the present invention can be achieved by providing a box cutting method characterized in that after forming a cutting unit consisting of a plurality of boxes, said plurality of boxes forming said cutting unit are clamped by a box clamping device, said plurality of boxes being cut collectively by moving a cutter along a cutting line formed on said boxes.

That is, according to a box cutting method according to the present invention, a box can be cut with high efficiency by collectively cutting a plurality of boxes.

Similarly, the third object of the present invention can be achieved by providing a box cutting method including an independent movement step for independently moving a plurality of cutter body portions adapted to cut boxes in the generally vertical direction, and a synchronous movement step for moving said plurality of cutter body portions in synchronism with each other in the generally vertical direction, said method being characterized in that a desired cutter body portion is brought to a lower position by said independent movement step, and said cutter body portion situated in the lower position is moved to a position corresponding to the height of said box by said synchronous movement step.

The third object of the present invention can also be achieved by providing a box cutting apparatus, which is capable of carryhing out the above-mentioned method in a suitable manner, including a plurality of cutters for cutting a box, and a vertical movement device for moving said cutters in the generally vertical direction, said apparatus being characterized in that each of said cutters includes a cutter body portion, and a cutter body portion in the generally vertical direction.

That is, according to a box cutting method of the present invention which uses a box cutting apparatus of the present invention, only a desired upper edge portion of a box can be cut by including an independent movement step for independently moving a plurality of cutter bodies adapted to cut a box in the generally vertical direction.

Likewise, the fourth object of the present invention can be achieved by providing a box cutting method including a goods putting aside step for putting goods contained in a box inwardly and a cutting step for cutting said box, said method being characterized in that said goods are brought to a position away from an upper edge portion of said box by said goods putting aside step, and said upper edge portion is cut by said cutting step.

The fourth object of the present invention can also be achieved by providing a box cutting apparatus, which is capable of carrying out the above-mentioned method in a suitable manner, including a cutter having a cutter body portion and a box pressing portion, and a back and forth movement device for moving said cutter along a cutting line formed on a box, said apparatus being characterized in that said cutter body portion cuts an upper edge portion of said box and said box pressing portion presses a side surface situated beneath said upper edge portion.

That is, according to a box cutting method of the present invention which uses a box cutting apparatus of the present invention, an upper edge portion of a box can be cut without damaging goods contained in the box by putting the goods contained in the box inwardly.

Similarly the fifth object of the present invention can be achieved by providing a box cutting method, wherein an upper edge portion of a box is cut by inserting a cutting knife at angles with respect to a top surface of said box, said method being characterized in that said cutting knife is inserted in such a manner as to have a predetermined distance from an external side of a side surface situated beneath said upper edge portion.

The fifth object of the present invention can also be achieved by providing a box cutting apparatus, which is capable of carrying out the above-mentioned method in a suitable manner, including a cutting knife disposed at angles with respect to a top surface of a box, and a back and forth movement device for moving said cutting knife along a cutting line formed on said box, said apparatus being characterized in that an upper edge portion of said box is cut by said cutting knife which is moved by said back and forth movement device.

That is, according to a box cutting method using a box cutting apparatus of the present invention, an upper edge portion of a box can be cut without generating cutting chips by inserting a cutting knife at angles with respect to a top surface of the box.

Likewise, the sixth object of the present invention can be achieved by provding a box cutting method including a box detection step for detecting a top surface of a box, and a cutting depth selection step for selecting the preset cutting depth from said top surface in accordance with said box, said method being characterized in that after moving a cutting knife into a position corresponding to the cutting depth selected by said cutting depth selection step, said box is cut by moving said cutting knife along a cutting line formed on said box.

That is, by the box cutting method of the present invention, a box can be cut with accuracy and with reliability by moving a cutting knife first to a position of a preset depth from a top surface of the box and then moving the cutting knife along a cutting line formed on the box.

Similarly, the seventh object of the present invention can be achieved by providing a box cutting method characterized in that after moving a cutting knife inwardly by a desired distance from a position where a clamping plate presses a side surface of a box, said box is cut by moving said cutting knife along a cutting line formed on said box.

According to a box cutting method of the present invention, a box can be cut with accuracy and reliability by determining a position of a cutting knife with reference to a position where a clamping plate presses the side surface of the box.

The above and other objects and characteristic features and advatages of the present invention will become more apparent parent to those skilled in the art as the disclosure is made in the following description of preferred embodiments of the invention, as illustrated in the accompanying drawings.

DETAILED DESCRIPTION OF THE PREFERRED EMBODIMENTS

One embodiment of a box cutting apparatus of the present invention will be described first.

Figure 1:
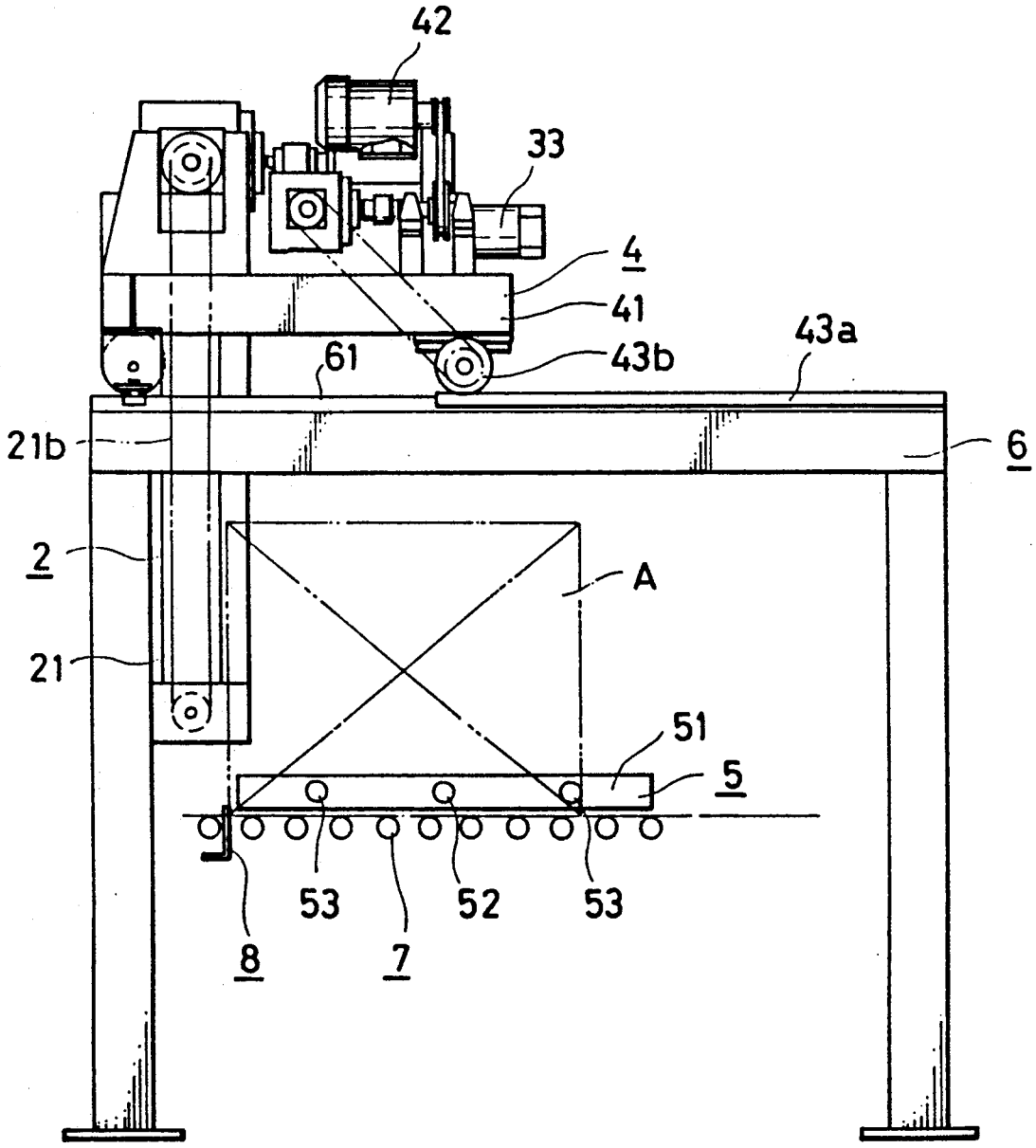
FIG. 1 is a front view showing one embodiment of a box cutting apparatus according to the present invention.
Figure 2:
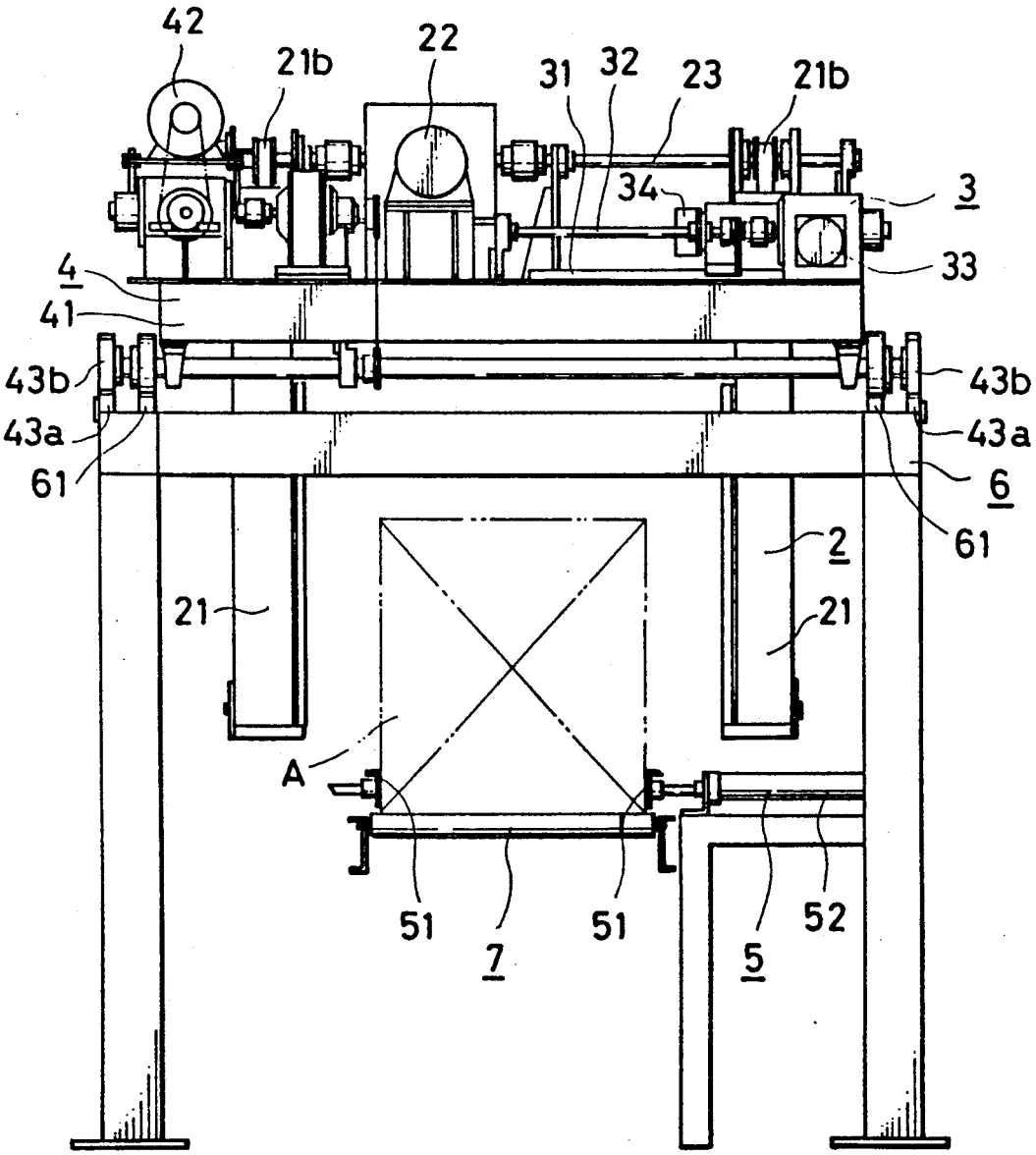
FIG. 2 is a side view thereof.
Figure 3:
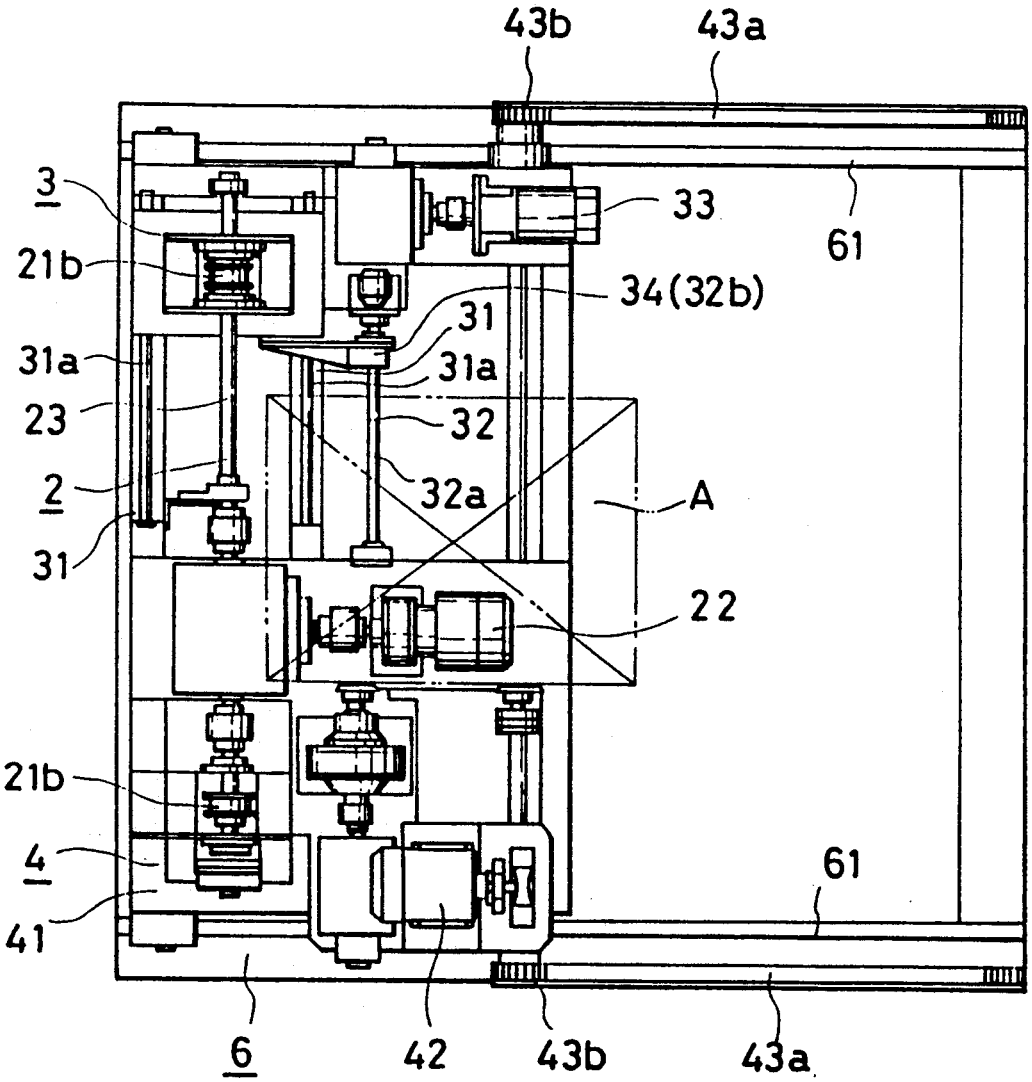
FIG. 3 is a plan view thereof.
Figure 4:
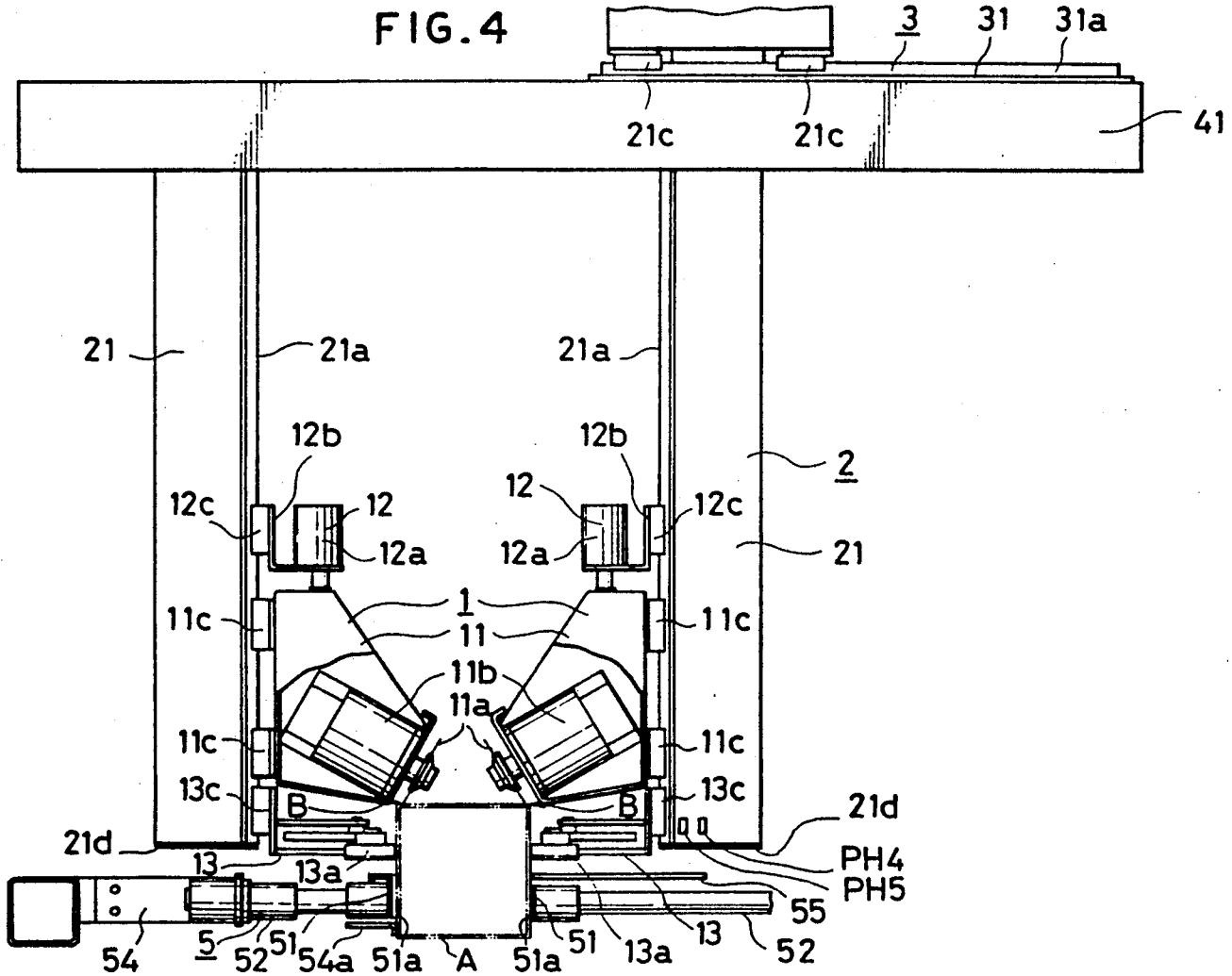
FIG. 4 is a side view showing the details of an important portion thereof.
Figure 5:
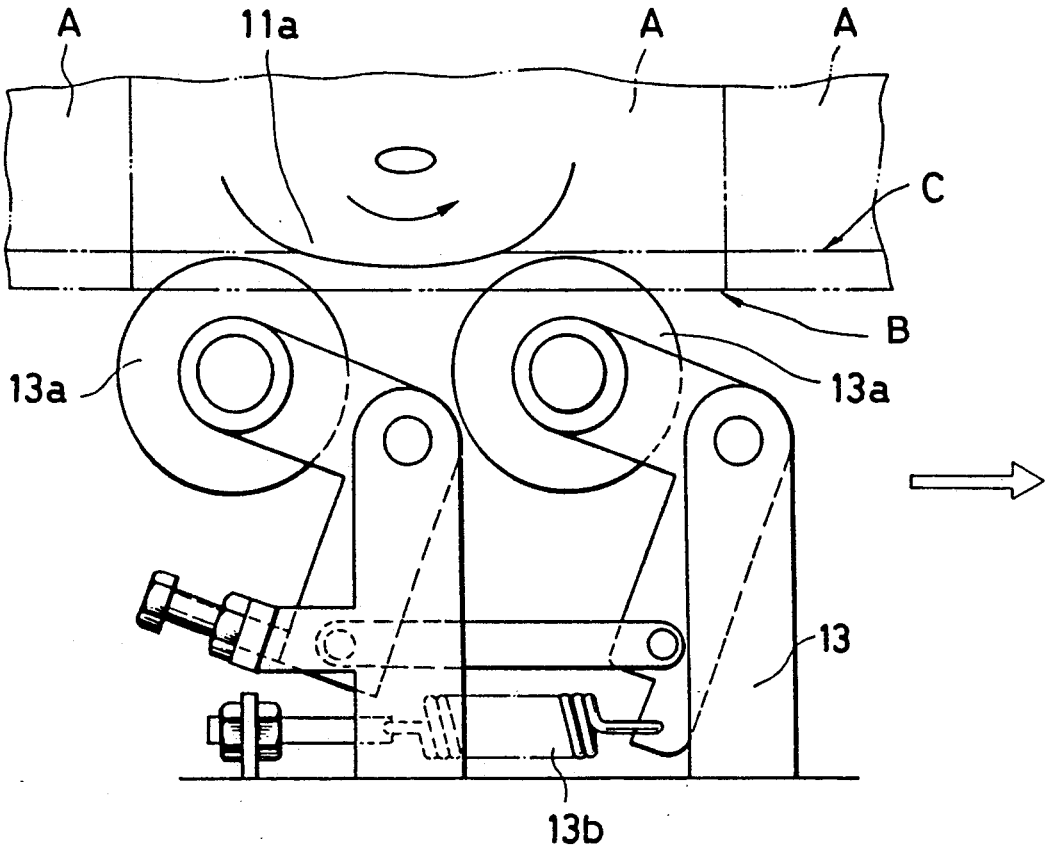
FIG. 5 is a plan view showing the details of an important portion in the vicinity of a press roller portion thereof.

FIG. 1 is a front view showing one embodiment of the present invention, FIG. 2 is a side view thereof, FIG. 3 is a plan view thereof, and FIG. 4 is a side view showing the details of an important portion thereof. In these figures, reference numeral 1 denotes a cutter (cutter 1 is not shown in FIGS. 1 through 3) for cutting a box A reference numeral 2 denotes a vertical movement device for moving the cutter 1 in the generally vertical direction, reference numeral 3 denotes a horizontal movement device for moving the cutter 1 in the generally horizontal direction, reference numeral 4 denotes a back and forth movement device for moving the cutter 1 along a cutting line C formed on the box A, and reference numeral 5 denotes a box clamping device (clamping device 5 is not shown in FIG. 3) for pressing the box A in the generally horizontal direction. After the cutter 1 is moved to a predetermined position by the vertical movement device 2 and horizontal movement device 3 in accordance with the size of the box A, the cutter 1, as shown in FIG. 5, is moved along the cutting line C formed on the box A in order to cut an upper edge portion B of the box A which is in a stopped state.

Various component ports of the above-mentioned embodiment will be described. As shown in FIGS. 4 through 7, in order to cut two upper edge portions B of the right and left sides of the box A simultaneously or in order to cut either one of them, two sets of cutters 1 are provided. Each of the cutters 1 of the present invention, as a shown in FIG. 4, comprises a cutter body portion 11 including a rotary knife 11*a* as a cutting knife, a motor 11*b* connected to the rotary knife 11*a*, and a pair of upper and lower linear bearings 11*c*, 11*c*, etc. an air cylinder portion 12 is provided as a cutter body vertical movement portion of the present invention including an air cylinder 12*a*, a bracket 12*b* with the air cylinder 12*a* mounted thereon, and a linear bearing 12*c* mounted on the bracket 12*b*, etc. An press roller portion 13 is provided as a box pressing portion of the present invention adapted to press the box A including a press roller 13*a*, a spring 13*b* for urging the roller 13*a* against the box A, a linear bearing 13*c*, etc. desired cutter body portion 11 is independently brought to a lower position by the air cylinder 12*a* of the air cylinder portion 12, and the cutter body portion 11 in the lower position is moved in the generally vertical direction by the vertical movement device 2 as will be described so as to bring the cutter body portion 11 to a position corresponding to the height of the box A.

Figure 12:
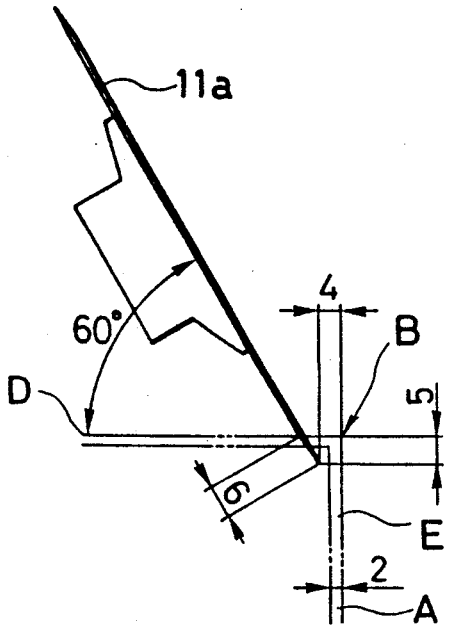
FIGS. 12 through 14 are explanatory views showing a positional relation between the rotary knife and the box when the box is cut.
Figure 13:
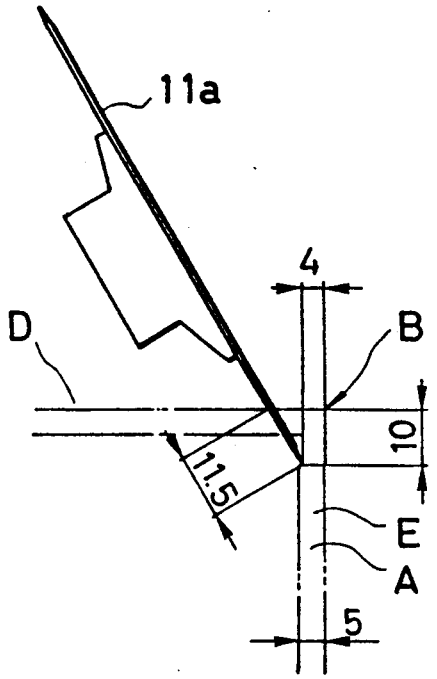
Figure 14:
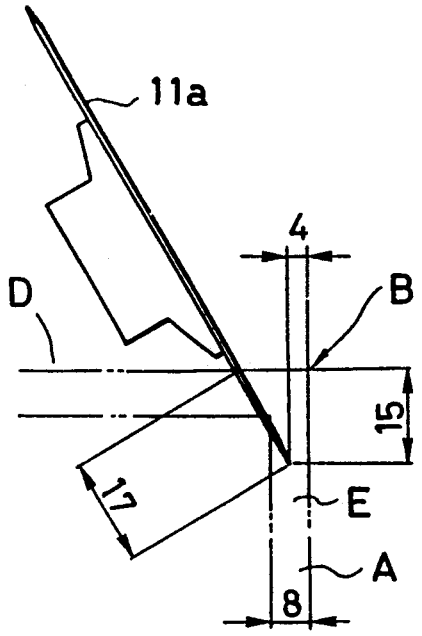

FIGS. 12 through 14 show the embodiments of the rotary knife 11*a* suitable for cutting a box A formed of a corrugated board having a thickness of from 2 mm to 8 mm. However, the present invention is by no means limited to these embodiments. That is, the rotary knife 11*a* is disposed at angles with respect to a top surface D of the box A. More specifically, the rotary knife 11*a* is attached at an angle of 60°. However, the knife 11*a* may preferably be attached at an angle of from 30° to 120° and more preferably at an angle of from 45° to 75° . Similarly, the figures show the embodiments of from 5 mm to 15 mm as the cutting depth in the vertical direction. However, it may preferably be from 2 mm to 30 mm, and more preferably from 3 mm to 20 mm. Likewise, the figures show the embodiments of 4 mm as the cutting depth in the horizontal direction. However, it may preferably be from 1 mm to 10 mm, and more preferably from 3 mm to 5 mm. Also, as shown in FIG. 6, a push amount of the press roller 13*a* may be from 3 mm to 15 mm with respect to the upper edge portion B of the box A, and more preferably from 6 mm to 10 mm.

Figure 8A:
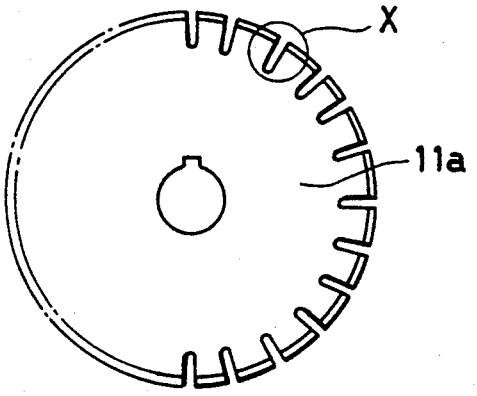
FIGS. 8*a* and 8*b* are front and side views, respectively, showing one example of a rotary knife thereof.
Figure 8B:
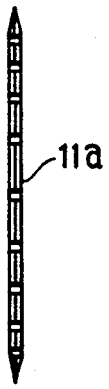
Figure 9:
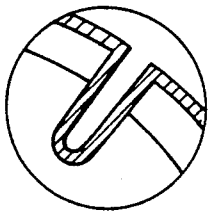
FIG. 9 is an enlarged view of a portion indicated by X of FIG. 8.
Figure 10A:
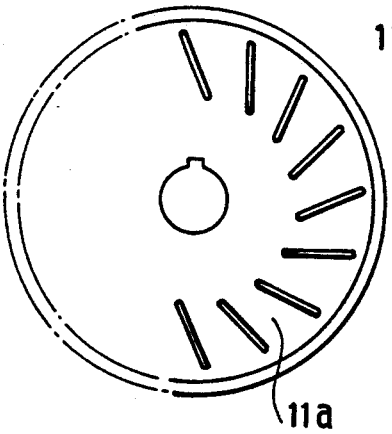
FIGS. 10*a* and 10*b* are front and side views, respectively, of another example of the rotary knife.
Figure 10B:
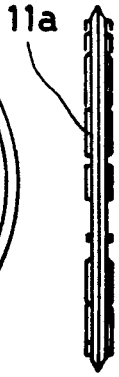
Figure 11A:
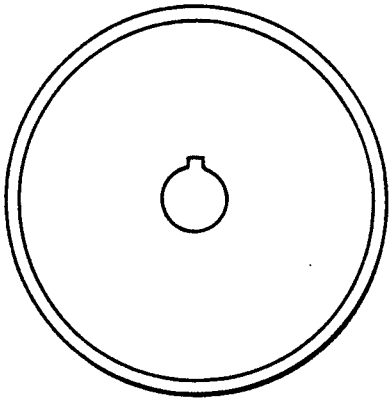
FIGS. 11*a* and 11*b* are front and side views, respectively, of a rotary file thereof.
Figure 11B:
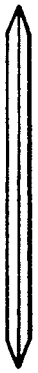

Also, as the rotary knife 11*a*, a sharp rotary knife such as a round blade may be used. Otherwise, there may be used various shapes of knives as shown in FIGS. 8 through 10 for example. That is, when a sharp knife such as a round tooth is used, the cutting line C, i.e., the edge portion of the cutting plane becomes too sharp and a hand is sometimes injured by the edge portion of the cutting plane when goods are taken out of the box A. Therefore, in the illustrated examples, the rotary knife 11*a* is formed such that the cutting plane is made somewhat rough in order not to injure the hand but not so rough as to generate cutting chips. FIGS. 8 and 9 show an example, in which the rotary knife is provided with a plurality of slits on its periphery and the blades are provided to the hatched portion. Also, FIG. 10 shows an example of the rotary knife in which the rotary knife is provided on its side surface with a small knob. Also, FIG. 11 shows an example of a rotary file for roughening the plane which was cut by the sharp round blade rotary knife 11*a*. The rotary file is disposed behind the rotary knife 11*a* separately from the rotary knife 11*a*.

The rotary file is preferably thicker than the thickness of the rotary knife 11*a*.

Figure 6:
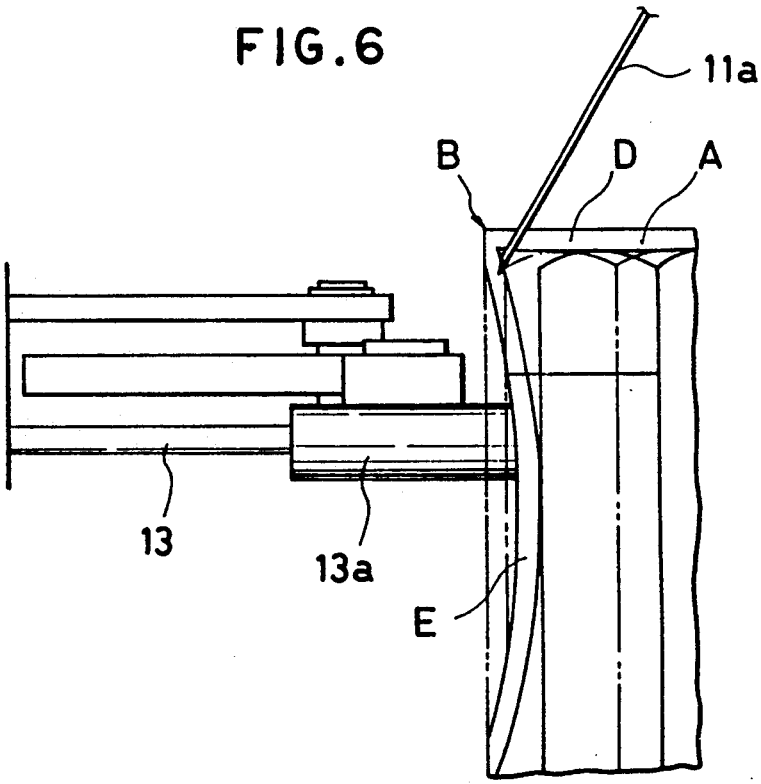
FIG. 6 is a side view showing the details of an important portion in the vicinity of the press roller portion.
Figure 7:
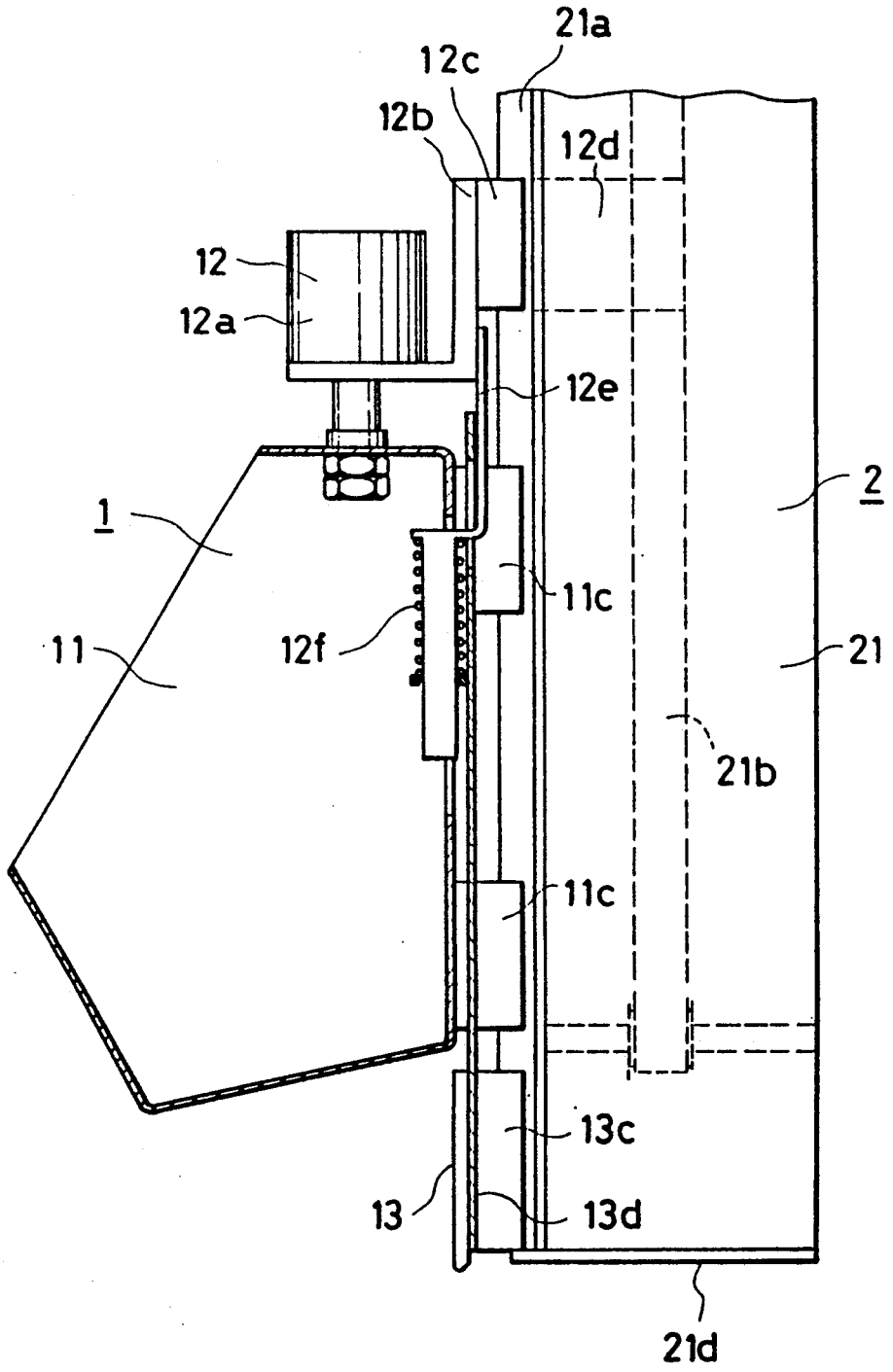
FIG. 7 is a side view showing the details of an important portion of a cutter and a vertical movement device thereof.

Furthermore, the press roller portion 13, as shown in FIG. 6, is designed such that the press roller 13*a* is caused to press an upper portion of the side surface E beneath the upper edge portion B to be cut of the box A in the horizontal direction. The press roller portion 13, as shown in FIG. 7, is connected with respect to a rod portion hanging down from a hook 12*e* vertically mounted to the bracket 12*b* for fixing the air cylinder 12 through a plate 13*d* mounted on the linear bearing 13*c* of the press roller 13, and the rod portion is resiliently provided with a spring 12*f*, so that the press roller 13 is moved in the vertical direction in accordance with the vertical movement of the air cylinder portion 12. In case a low box A is cut, as the lowering movement of the cutter body portion 11 and the air cylinder portion 12 by means of activation of the vertical movement device 2 along the linear rail 21*a* causes the press roller portion 13 to be lowered to a position where the press roller portion 13 interferes with the box clamping device 5 along the linear rail 21*a*, the linear rail 21*a* is provided at its lower end with a stop plate 21*d* so that the press roller portion 13 would not be lowered exceeding the stop plate 21*d*. That is, when the press roller portion 13 is brought to the stop plate 21*d* in accordance with the lowering movement of the cutter body portion 11 and the air cylinder portion 12, the spring 12*f* is compressed and the press roller portion 13 is not lowered exceeding that point.

Figure 15:
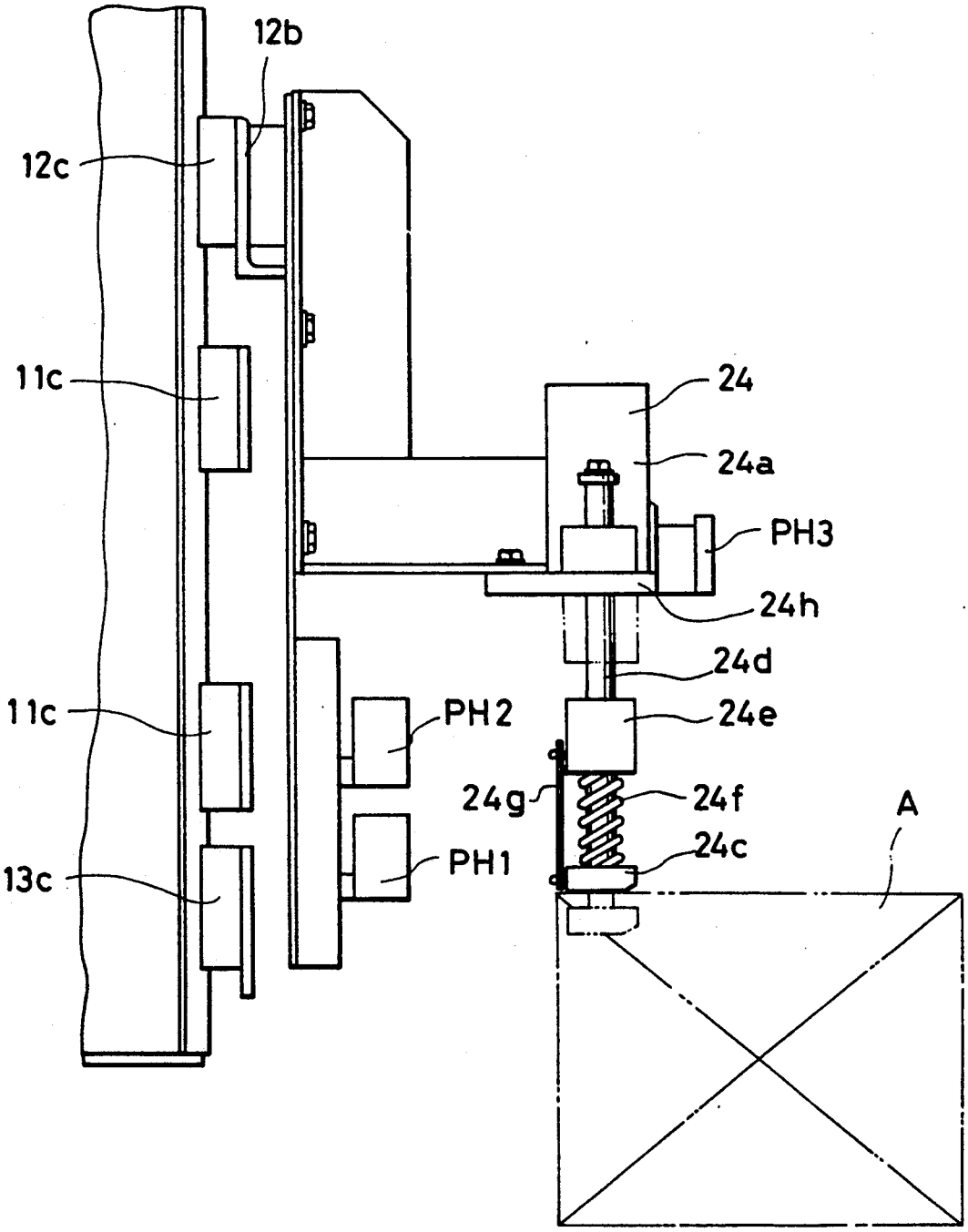
FIG. 15 is a side view showing the details of an important portion in the vicinity of a height detector thereof.
Figure 16:
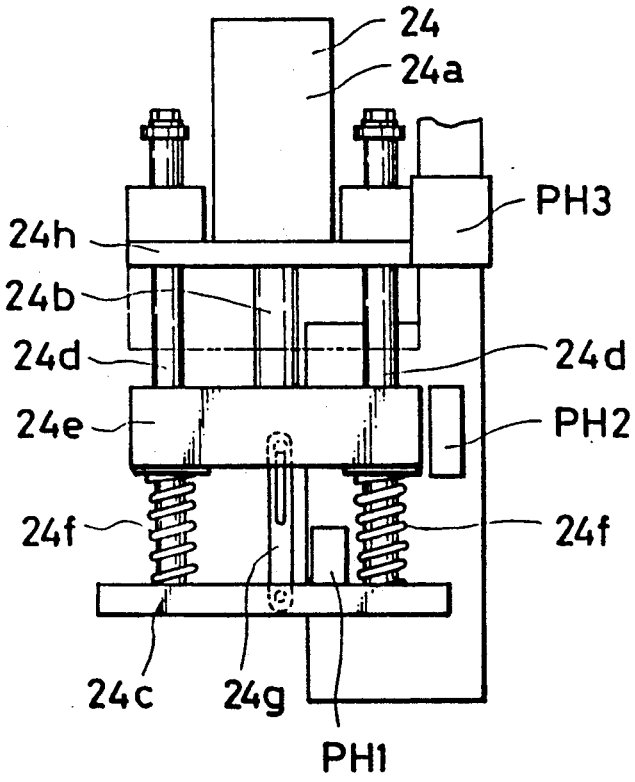
FIG. 16 is a front view showing the details of an important portion in the vicinty of the height detector.

Also, the vertical movement device 2, as shown in FIGS. 2, 3, 4 and 7, comprises a pair of lifting masts 21, 21 including a linear rail 21*a* disposed in the vertical direction, a timing belt 21*b* juxtaposed to the linear rail 21*a*, and a linear bearing 21*c*. A motor 22 and a driving shaft 23 are disposed on a traveling truck 41 and are adapted to drive the timing belt 21*b*. A height detector 24 disposed in the vicinity of a lower end of the lifting mast 21 and adapted to detect the height of the box A. The vertical movement device 2 is connected with the timing belt 21*b* through the plate 12*d* mounted on the linear bearing 12*c* of the air cylinder portion 12, and the rotation of the timing belt 21*b* causes the cutter 1 to be moved in the vertical direction. One lifting mast 21 is moved on the linear rail 31*a* of a horizontal movement device 3 as will be described in the generally horizontal direction through the linear bearing 21*c* (see FIGS. 3 and 4). On the other hand, the other lifting mast 21 is fixed with respect to the horizontal direction. Also, the height detector 24, as shown in FIGS. 15 and 16, comprises an air cylinder 24*a*, a box detecting plate 24*c*, a plate mounting rod 24*d*, a boss member 24*e*, a spring 24*f*, and a long hole plate 24*g*. The height detector 24 is mounted on the bracket 12*b* of the air cylinder portion 12 of the cutter 1 through a bracket 24*h*. A piston rod 24*b* of the air cylinder 24*a* is provided at its one end with the boss member 24*e*. Lower ends of a pair of plate mounting rods 24*d*, 24*d*, which penetrate through the boss member 24*e* and the bracket 24*h* at both sides of the piston rod 24*b*, are attached with a box detecting plate 24*c*. Also, between the box detecting plate 24*c* and the boss member 24*e*, the spring 24*f* is disposed such that the plate mounting rod 24*d* is wound therearound with the spring 24*f*. The box detecting plate 24*c* is normally pushed down by the spring 24*f*. Also, the long hole plate 24*g* interconnects the box detecting plate 24*c* and the boss member 24*e*. And, the boss member 24*e* is moved within the range of the long hole of the long hole plate 24*g* by means of the activation of the air cylinder 24*a* through the piston rod 24*b* so as to move the box detecting plate 24*c* in the generally vertical direction.

Also, the horizontal movement device 3, as shown in FIGS. 2 through 4, comprises a width narrowing bed 31 including a linear rail 31*a*, disposed on a traveling truck 41, a ball screw 32 disposed in parallel relation with the width narrowing bed 31, and a motor 33 for driving a screw shaft 32*a* of the ball screw 32. In accordance with the rotation of the screw shaft 32*a* of the ball screw 32, a plate 34 provided with a nut 32*b* is moved in the generally horizontal direction, and one lifting mast 21 is moved in the generally horizontal direction through the movement of the plate 34. The horizontal movement device 3 is moved in the back and forth direction in accordance with the traveling of the traveling truck 41 of the back and forth movement device 4, as will be described.

Also, the back and forth movement device 4, as shown in FIGS. 1 through 3, comprises a traveling truck 41 adapted to travel on a pair of linear rails 61, 61 disposed in the back and forth direction on an upper surface of the frame 6, a motor 42 for driving the traveling truck 41, a rack 43*a* juxtaposed to an external side of each of the pair of linear rails 61, 61, and a pinion 43*b* connected with the motor 42 and adapted to mesh with the rack 43*a*. The traveling truck 41 is mounted thereon with the cutter 1, the vertical movement device 2, and the horizontal movement device 3. The cutter 1, which is moved to a predetermined position beforehand by the vertical movement device 2 and the horizontal movement device 3, is moved in the back and forth direction, i.e., in the direction along the cutting line C (the direction generally perpendicular to the horizontal direction) in accordance with the traveling of the traveling truck 41.

Also, the box clamping device 5, as shown in FIGS. 1, 2 and 4, comprises a pair of clamping plates 51, 51 each including a projection 51*a* disposed at each side of a transfer path of the box A and adapted to prevent the box A from falling and/or moving due to resistance generated when the box A is cut, a pair of air cylinders 52, 52 connected with the clamping plates 51, 51, and a pair of guide shafts 53, 53 disposed in both sides of the air cylinder 52. Lower portions of the side surfaces E of the box A are pressed in the generally horizontal direction by the pair of clamping plates 51, 51 in order to fix the box A. Also, a bracket 54 of the box clamping device 5 is provided with a fixed guide 54*a*. In case the box A is high (for example, more than 300 mm in height), if only the lower portions of the side surfaces E of the box A are clamped by the pair of the clamping plates 51, the box A is sometimes clamped in an inclined state. Therefore, in addition to the above-mentioned clamping plates 51, it is preferable to provide another pair of clamping plates (not shown) in order to press upper portions of the side surfaces E of the box A in the generally horizontal direction.

Next, a box cutting system using two box cutting devices of the present invention will be described.

Figure 17:
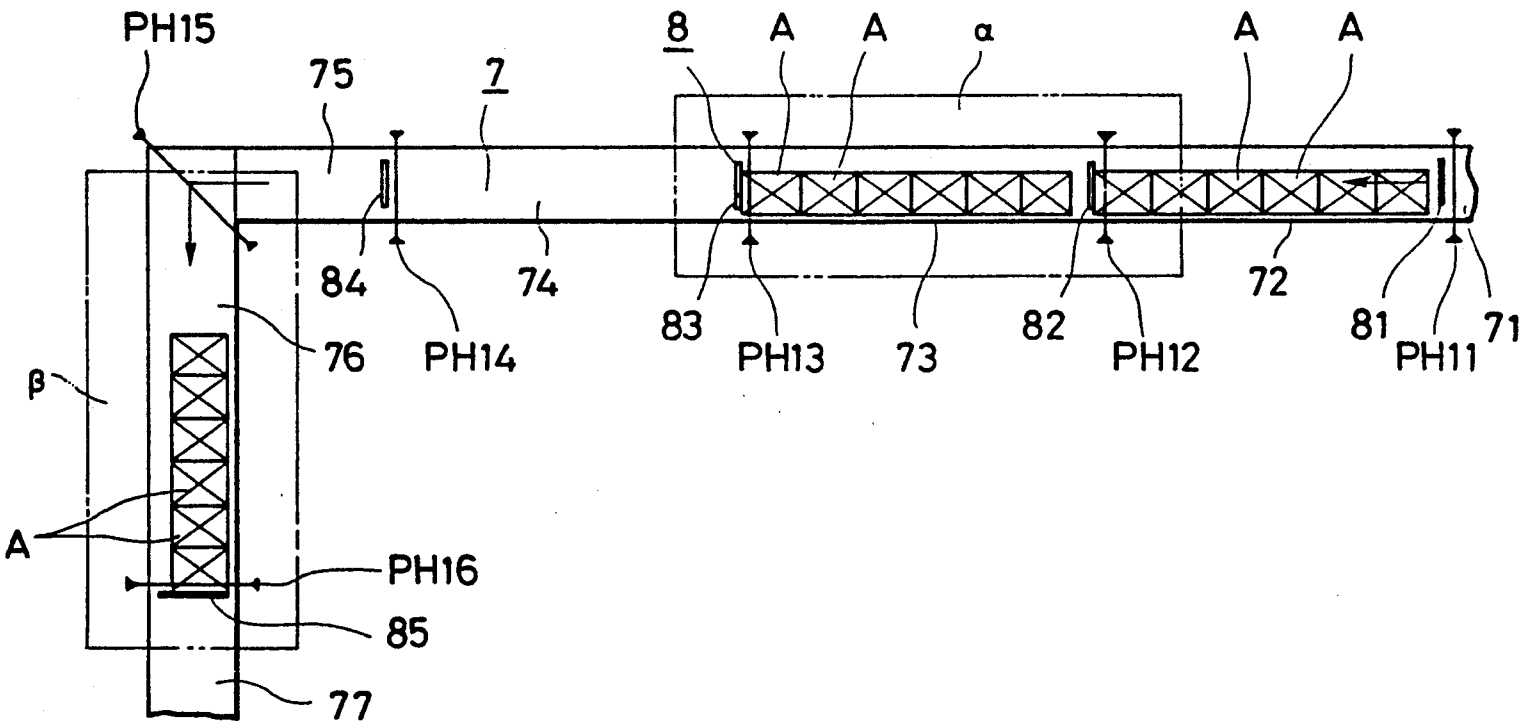
FIG. 17 is an arrangement view showing a box cutting system, in which two box cutting apparatuses of the present invention are used.

FIG. 17 is an arrangement view showing one embodiment of the above-mentioned system. In the figure, $\alpha$ denotes a first box cutting apparatus adapted to cut two upper edge portions B in the longitudinal direction of the box A, $\beta$ denotes a second box cutting apparatus adapted to cut two upper edge portions B in the width direction of the box A, element 7 denotes a transfer conveyor including (roller) conveyors 71, 72, 73, . . . which are adapted to transfer the box A, and element 8 denotes a box stopper including stoppers 81, 82, 83, . . . adapted to stop the box A. The box cutter apparatuses $\alpha$ and $\beta$ shown in FIG. 17 are designed such that the a dimension of the cutter 1 able to move in the back and forth direction is larger than that of the box cutting apparatus shown in FIGS. 1 through 3 in order to cut a plurality of boxes A by a single back and forth movement of the cutter 1. In the above-mentioned box cutting system, after a cutting unit consisting of a plurality of boxes A which are cut by a single back and forth movement of the cutter 1 is formed, the plurality of boxes A forming the cutting unit are clamped by the box clamping device 5 and the cutter 1 is moved along the cutting line C formed on the boxes A in order to collectively cut the upper end portions B of the boxes A. Also, the transfer conveyor 7 is provided at its upstream side with a depalletizer (not shown).

One mode for carrying out of a box cutting method of the present invention will be described next with reference to the embodiment wherein the above-mentioned box cutting apparatus is used.

In one mode for carrying out a box cutting method of the present invention, first, at least one of a plurality of boxes A depalletized by the depalletizer are collected into groups for each kind of goods and transferred in the longitudinal direction to pass the conveyor 71, then transferred to the conveyor 72 while being counted by a photoswitch PH11 and stopped by the stopper 82 in sequence. When the maximum number registered in a control CPU (not shown) beforehand as a number able to be cut at a time for each kind of goods is detected by the photoswitch (PH11) or if the number of the boxes A to be cut is smaller than the maximum number, when the number to be cut is detected by the photoswitch (PH11), the stopper 81 is moved up to stop the following box A, and the feeding of the box A to the conveyor 72 is completed. At least one of a plurality of boxes A of the same kind of goods assorted on the conveyor 72 are put closely together in the forward direction by the stopper 82, and are then transferred to the conveyor 73. When the arrival of the foremost box A to the stopper 83 is detected by the photoswitch PH13, the conveyor 73 is stopped and two upper edge portions B in the longitudinal direction of the box A are cut by the cutters 1 of the first box cutting apparatus $\alpha$ as will be described. The boxes A, which were cut by the first box cutting apparatus $\alpha$, are transferred to the conveyor 74 and then individually separated by the stopper 84. Thereafter, the boxes A are transferred at right angles from the conveyor 75 to the conveyor 76. After being stopped by the stopper 85, the box A, which was cut in the longitudinal direction thereof, is further cut at two upper edge portions B in the width direction of the box A by the second box cutting apparatus $\beta$ and then transferred to the downstream side conveyor 77. Regarding the sequential order of cutting the box A, the width direction of the box A may be cut first and then the longitudinal direction thereof may be cut. Also, it is preferable that the conveyors 74 and 75 can move at a higher speed than the conveyor 73. Also, the cut-out top surface D of the box A is removed by suitable means such as, for example, absorption by a vacuum head, removal by a worker or the like.

As described in the foregoing, the boxes A, which were depalletized by the depalletizer, are collected into groups for each kind of goods and transferred in the longitudinal direction and then stopped on the conveyor 73. That is, when the cutting unit consisting of a plurality of boxes A is formed, two upper edge portions B in the longitudinal direction of the box A are cut by the box cutting apparatus $\alpha$. That is, first, in order to fix the plurality of boxes A, which form the cutting unit, to a predetermined position, the lower portions of both side surfaces E of each box A are pressed in the generally horizontal direction and clamped by the pair of clamping plates 51, 51 of the box clamping device 5 in such a manner as to be fixed to the predetermined position. At this time, the clamping plate 51 at the side of the fixed guide 54*a* is always pushed out to a predetermined position, and the other clamping plate 51 is pushed out until the box A is pressed against the box A at the side of the fixed guide 54*a*. Each of the pair of clamping plates 51, 51 is provided with a limit switch (not shown), respectively. By virtue of the foregoing limit switch, completion of the fixing work of the box A to the predetermined position can be detected by detecting the completion of the pressing action of the clamping plates 51, 51 against the box A.

When the box A has been fixed to the predetermined position, the rotary knife 11*a* is inserted at angles with respect to the top surface D of the box A to start the cutting operation to the upper edge portion B of the Box A. That is, the rotary knife 11*a* starts its rotation, and the rotary knife 11*a* as will be described moves in the vertical and horizontal directions until it reaches an extension line of the upper edge portion B of the box A. That is, the synchronous movement step for synchronously moving a plurality of cutter body portions 11 in the generally vertical direction causes the cutter body portion 11, which is brought to a lower position by an independent movement step as will be described, to be moved to a position corresponding to the height of the box A. At this time, if two upper edge portions in the longitudinal direction of the box A are required to be cut, the cutter body portions 11, 11 are brought to the lower position, i.e., the cutting position, by the air cylinders 12*a*, 12*a*. On the contrary, if one of the upper edge portions B is not required to be cut, the cutter body portion 11 at the side of non-cutting upper edge portion B is brought to the upper position, i.e., the non-cutting position, by the air cylinder 12*a*. That is, the independent movement step for independently in a generally vertical direction the plurality of cutter body portions 11 adapted to cut the box A causes a desired cutter body portion 11 to be brought to the lower position. As described in the foregoing, as the air cylinders 12*a*, 12*a* can independently be activated, two upper edge portions B in the longitudinal direction of the box A can simultaneously be cut or one of the upper edge portions B can selectively be cut. Therefore, by using two box cutting apparatuses $\alpha$ and $\beta$, all of the four upper edge portions B of the box A can be cut. It is also possible that only one upper edge portion B is cut, or two upper edge portions B are cut in an L-shape, or three upper edge portions B are cut in a generally C-shape according to necessity. There will be described hereunder a case where four upper edge portions B are all cut.

In order to make setting of position in the vertical direction, the cutter 1 is lowered first from a predetermined height by the vertical movement device 2 and then, the top surface D of the box A is detected by the height detector 24 (box detection step). That is, when the box A is fixed to a predetermined position by the box clamping device 5, the air cylinder 24*a* pushes down the boss member 24e to a position (the position indicated by the solid line in FIGS. 15 and 16). As a result, the box detecting plate 24c connected with the boss member 24e is also pushed down to a position (the position indicated by the two dotted chain line in FIG. 15). The start of a downward movement of the bracket 12b of the air cylinder portion 12 of the cutter 1 by the vertical movement device 2 also causes the height detector 24 mounted on the bracket 12b to be lowered. Upon contact of the box detecting plate 24c with the top surface D of the box A, the box detecting plate 24c stops at the position but the cutter 1 and the bracket 24h are continuously lowered. And, when the photoswitch PH1 mounted on the bracket 24h detects the box detecting plate 24c, the photoswitch PH1 starts a pulse counting of a counter number preset by an encoder mounted on a driving shaft 23 of the vertical movement device 2. That is, in accordance with the configuration, dimension, etc. of the upper edge portion B of the box A to be cut, as shown for example in FIG. 12 through 14, a preset cutting depth from the top surface D is selected with reference to the count number of the encoder (cutting depth selection step). Therefore, the cutter 1 is continuously lowered from the position of the top surface D detected by the afore-mentioned box detection step until the pulse count reaches the preset value and causes the rotary knife 11a to be brought to a cutting position by an amount of the cutting depth selected by the cutting depth selection step. When the pulse count reaches the preset value, the rotary knife 11a of the cutter 1 is brought to the position of a proper cutting depth. After the cutter 1 is correctly positioned with respect to the vertical direction, the air cylinder 24a draws up the boss member 24e to a position (the position indicated by the two dotted chain line) so that the box detecting plate 24c would not interfere with the box A when cutting. PH2 denotes a cutting depth abnormal detecting photoswitch which is disposed to a position slightly above the photoswitch PH1, and PH3 denotes a reflection type photoswitch which is disposed one-sided to the bracket 24h and adapted to detect an approaching state of the box A which is located in a lower position. When the approaching state of the top surface D of the box A is detected by the reflection type photoswitch PH3, the lowering speed of the vertical movement device 2 is switched from a high speed to a low speed.

Also, the rotary knife 11a of one cutter 1 is moved in the generally horizontal direction from outside the side surface E of the box A located beneath the upper edge portion B to inside thereof by a predetermined distance, i.e., in such a manner as to have 4 mm simultaneously with the above-mentioned lowering movement. As a result, the rotary knife 11a of the cutter 1 is brought to a position on the extension line of the upper edge portion B of the box A which is fixed to a predetermined position by means of pressing of the clamping plate 51 exerted to the side surface E of the box A. That is, in order to correctly position, the cutting knife 11a is moved inwardly from the above-mentioned position by a desired distance by narrowing the width of the lifting mast 21 with respect to the horizontal direction, with reference to the position of a dog 55 disposed at the clamping plate 51 at the opposite side of the clamping plate 51 at the fixed guide 54a which presses the side surface E of the box A. A photoswitch PH4, as shown in FIG. 4, is disposed in the vicinity of a lower end of the lifting mast 21 and adapted to detect the position of the dog 55 from above so as to stop the cutting knife 11a on the extension line of the upper edge portion B of the box A. Also, a photoswitch PH5 is adjacent to the photoswitch PH4 and adapted to switch the width narrowing speed of the horizontal movement device 3 from a high speed to a low speed.

As described in the foregoing, when the rotary knife 11a is brought to the position on the extension line of the upper edge portion B of the box A, the cutter 1 is moved in the direction as indicated by the arrow along the cutting line c as shown in FIG. 5 and causes the rotary knife to cut into the top surface D of the box A from a diagonal direction while allowing the rotary knife 11a to be rotated as shown in FIG. 6. As a result, the upper edge portions B of a plurality of boxes A can collectively be cut (cutting step). When the rotary knife 11a is moved in the direction as indicated by the arrow in FIG. 5 along the cutting line C, the press roller 13a, as shown in FIG. 5, presses the upper portion of the side surface E beneath the upper edge portion B of the box A by means of the spring 13b. As a result, goods contained in the box A are put aside inwardly (goods putting aside step) so that the goods would be away from the rotary knife 11a, i.e., the upper edge portion B of the box A. Accordingly, the upper edge portion B of the box A can be cut without damaging the goods contained in the box A. That is, as the upper edge portion B of the box A is tough and not easily put aside inwardly even if a pressure is exerted, only the goods contained in the box A and the side surface E of the box A can be put aside inwardly.

When the cutting of the box A is finished, the cutter 1 is returned to a predetermined position, that is, to the upper end position by the vertical movement device 2, to the right end position by the horizontal movement device 3, and to the front end position by the back and forth movement device 4, respectively. Also, the box clamping device 5 releases the box A, the conveyor 73 is actuated, the stopper 83 is lowered, the box A is transferred to the second box cutting apparatus $\beta$ via the downstream side conveyors 74, 75 and 76, and then two upper edge portions in the width direction of the box A are cut by the second box cutting apparatus $\beta$ in the same manner as the preceding case where two edge portions in the longitudinal direction of the box A are cut by the first box cutting apparatus $\alpha$. Then, the box A with its four upper edge portions already cut is transferred to the conveyor 77 in the same manner as the preceding case where the box A is transferred to the conveyor 74. In case the following box A is identical with the preceding box A, it is preferable that the cutter 1 is returned to a position higher by approximately 150 mm from the current position by the vertical movement device 2, to a position away by approximately by 50 mm in the right-hand direction by the horizontal movement device 3 and to the front end position by the back and forth movement device 4, respectively, instead of returning the cutter 1 to the predetermined position.

Although several embodiments of a box cutting apparatus of the present invention and several modes for carrying out a box cutting method of the present invention have been described, the present invention is not limited to these embodiments nor modes.

Also, the traveling truck 41 of the back and forth movement device 4 may be moved by a chain or by a motor for driving the chain.

Also, the press roller portion 13 may be omitted thereby enabling the box clamping device 5 to perform the press function in place of the press roller 13.

Also, as the detector 24 for detecting the height of the top surface D of the box A, there may be provided a plurality of photoswitches adapted to detect the top surface D of the box A so that the cutting depth is selected with reference to a photoswitch which has detected the top surface D.

As a box cutting method and an apparatus for carrying out the method of the present invention, as described in the foregoing, is designed such that a cutter is moved along a cutting line formed on a box, an upper edge portion of the box can be cut with accuracy and with reliability.

Furthermore, as it includes a box clamping device adapted to press a box in the generally horizontal direction, the box is cut in a stopped state. Accordingly, the box is not swayed and/or deformed. As a result, goods contained in the box are not injured and the box is not cut in a wrong manner.

Moreover, as a plurality of boxes are collectively cut, the boxes can be cut with high efficiency.

By cutting a box in a stopped state, the box is not swayed nor deformed. As a result, goods contained in the box are not injured and the box is not cut in a wrong manner.

Also, as it includes an independent movement step adapted to independently move a plurality of cutter body portions for cutting a box in the generally vertical direction, that is, as it includes a cutter body vertical movement portion adapted to move the cutter body portions in the generally vertical direction, only a desired upper edge portion or portions can be cut.

And, as it includes a horizontal movement device adapted to move a cutter in the generally horizontal direction, a back and forth movement device adapted to move the cutter along a cutting line formed on a box, and a box clamping device adapted to press the box in the generally horizontal direction, and as the box is cut in a stopped state, the box is neither swayed nor deformed. As a result, goods contained in the box are not injured and the box is not cut in a wrong manner.

Also, as goods contained in a box are put aside inwardly, an upper edge portion of the box can be cut without injuring the goods contained in the box.

Also, as it includes a vertical movement device adapted to move a cutter in the generally vertical direction, a horizontal movement device adapted to move the cutter in the generally horizontal direction, and a box clamping device adapted to press the box in the generally horizontal direction, and as the box is cut in a stopped position, the box is neither swayed nor deformed. As a result, goods contained in the box are not injured, and the box is not cut in a wrong manner.

Also, as a cutting knife is inserted at angles with respect to a top surface of a box, an upper edge portion of the box can be cut without generating cutting chips.

And, as it includes a press roller portion, an upper edge portion of a box can be cut without injuring goods contained in the box.

Also, as a cutting knife is moved first to a position of a preset cutting depth from a top surface and is then moved along a cutting line formed on the box, an upper edge portion of the box can be cut with accuracy and with reliability.

Also, as the position of a cutting knife is determined with reference to a position where a clamping plate presses the side surface of a box, an upper edge portion of the box can be cut with accuracy and with reliability.

What is claimed is:

1. A box cutting method comprising the steps of:

a) forming a cutting unit consisting of a plurality of boxes;

b) clamping said plurality of boxes by a box clamping device;

c) positioning a cutter for cutting said plurality of boxes at a predetermined location beneath an upper edge portion of and in accordance with outer dimensions of said plurality of boxes;

d) moving said cutter along a predetermined cutting line on said plurality of boxes, said predetermined cutting line being defined by the positioning of said cutter with respect to said plurality of boxes; and e) stopping said plurality of boxes subsequent to said step of clamping said plurality of boxes, wherein the step of moving said cutter is performed against a plurality of boxes which are in a stopped state.

2. The box cutting method according to claim 1, further comprising the steps of:

providing a plurality of cutter body portions within said cutter;

independently moving at least one of said plurality of cutter body portions in a generally vertical direction;

positioning a desired one of said plurality of cutter body portions adjacent bases of said plurality of boxes by said step of independently moving;

synchronously moving remaining ones of said plurality of cutter body portions with each other in the generally vertical direction; and moving said cutter body portion situated in the lower position to a position corresponding to a height of said plurality of boxes by said step of synchronously moving.

3. The box cutting method according to claim 1, further comprising the step of:

inwardly putting aside goods contained in said box

4. The box cutting method according to claim 3, further comprising the steps of:

inserting said cutter at an angle with respect to a top surface of said box; and maintaining said cutter at a predetermined distance from an external side surface of said box situated beneath said upper edge portion.

5. The box cutting method according to claim 3, further comprising the steps of:

detecting a top surface of a box; and selecting a preset cutting depth from said top surface in accordance with predetermined dimensions of said box;

wherein said step of moving said cutter along said predetermined line includes the step of moving said cutter into a position corresponding to a cutting depth selected by said selecting step.

* * * * *